US005160908A

United States Patent [19]

Mullins et al.

[11] Patent Number: 5,160,908

[45] Date of Patent: Nov. 3, 1992

[54] CIRCUIT BREAKER ACTUATING DEVICE

[75] Inventors: Malcolm H. Mullins, Willingham; Frank Latham, Redbourn, both of England

[73] Assignee: M.K. Electric Limited, London, Great Britain

[21] Appl. No.: 651,443

[22] Filed: Feb. 6, 1991

[30] Foreign Application Priority Data

Aug. 30, 1990 [GB] United Kingdom ..... 9018911

[51] Int. Cl.[5] ..... H01H 3/00

[52] U.S. Cl. ..... 335/68; 335/69; 335/71

[58] Field of Search ..... 318/10, 12, 14, 15, 318/9, 280–286, 445–446, 453, 558; 335/26–28, 30, 68, 69, 70, 71, 72, 73

[56] References Cited

U.S. PATENT DOCUMENTS 2,864,911 12/1958 Brumfield ..... 335/69
3,332,043 7/1967 Camp ..... 335/71
3,973,230 8/1976 Ciarcia et al. .

*Primary Examiner*—Lincoln Donovan
*Attorney, Agent, or Firm*—Amster, Rothstein & Ebenstein

[57] ABSTRACT

The combination of a circuit breaker and an actuating member for the circuit breaker. The actuating device comprises an electric motor operable to displace a pair of actuating arms in opposite directions, one actuating arm being displaced along a path in which it is engageable with the manually-operable member of the circuit breaker to displace the member about its axis in one direction and the other actuating arm being displaced along a path in which it is engageable with the member to displace the member about its axis in the direction opposite to the first direction.

8 Claims, 4 Drawing Sheets

CIRCUIT BREAKER ACTUATING DEVICE

This invention relates to an improved actuating device for circuit breakers of the kind (hereinafter referred to as being of the "kind specified") which embody a manually operable member such as a switch-actuating member or a member operated by the switch actuating member directly or by way of a linkage or other mechanism, which is angularly displaceable about an axis through a top dead centre (TDC) position between two extreme positions towards which it is urged by biasing means such as a spring means after passing through the TDC position to produce a toggle or snap action effect, the member in one extreme position (the "ON" position) causing or allowing a movable contact to engage another contact and in the other extreme position (the "OFF" position) causing or allowing the moving contact to disengage the other contact. Such a circuit breaker can therefore be switched manually between the "ON" or circuit made condition and the "OFF" or circuit broken condition. Additionally, the circuit breaker may incorporate an electromagnetic device which is operable to trip the circuit breaker to break the circuit when a predetermined electrical condition is attained in an external electrical circuit. An example of such a circuit breaker is described in our co-pending applications Nos. GB-90 02678.2 filed Feb. 7, 1990 and U.S. Ser. No. 650,800 of even date and those disclosures are incorporated herein by reference.

Applications can be envisaged where it would be desirable to be able to reset the circuit breaker on command, perhaps from a remote location, once it has been triggered from the ON to the OFF condition and also to switch it on command from the ON condition to the OFF condition.

In our co-pending applications Nos. GB-90 11804.3 filed May 25, 1990 and U.S. Ser. No. 650,801 of even date we have disclosed a circuit breaker of the kind which is manually operable to make or break an electric circuit and which, when making an electric circuit, responds to an electric signal to break the circuit, the circuit breaker comprising a housing having a first face and an opposed second face, accessible electrical contacts exposed on each of said faces, an electrical connection between at least one of the contacts exposed on the first face and an associated contact exposed on the second face and at least one further contact exposed on said second face engageable with said at least one contact exposed on the first face of an adjacent similar circuit breaker. The structure there disclosed enables the circuit breakers to be used as modules and to be electrically and mechanically connected when disposed side-by-side. In one embodiment described, three such circuit breakers are disposed side-by-side and connected in the respective phases of a 3 phase supply and are sandwiched between a switch unit connected in the neutral phase and an electronics unit intended to process or respond to the line voltages and current transformer signals in a predetermined manner which can vary from application to application, the circuitry being tailored to the application.

In such systems, including those where there may be only a single phase or a 2 phase supply there exist applications where it would be desirable to have the facility remotely to displace the dolly of the or each circuit breaker from the ON to the OFF position and from the OFF to the ON position.

The disclosures of our applications Nos. GB-90 11804.3 and U.S. Ser. No. 650,801 are incorporated herein by reference.

According to the present invention there is provided the combination of a circuit breaker of the kind specified and an actuating device comprising an electric motor operable in response to an electric signal to displace an actuating arm along a path in which it engages the dolly, or an element associated therewith, and displaces the dolly towards and through the top dead centre position.

A plurality of circuit breakers of the kind specified may be arranged in connected relationship with the associated element in the form of a strap connecting the dollies together and the actuating arm may be arranged to engage the strap to actuate the dollies together.

With advantage the motor is operable to displace a pair of actuating arms in opposite directions, one actuating arm being displaced along a path in which it is engageable with the dolly or the element associated therewith to displace the dolly about its axis in one direction and the other actuating arm being displaced along a path in which it is engageable with the dolly or the element associated therewith to displace the dolly about its axis in the direction opposite to said one direction.

Preferably, the motor is arranged angularly to displace a pair of actuating arms in opposite directions about the respective axes of a pair of spaced parallel axes, the sweep of one arm passing through one extreme position of the dolly or the element associated therewith to displace the dolly towards the other extreme position and the sweep of the other arm passing through the other extreme position of the dolly or the element associated therewith to displace the dolly towards the one extreme position.

One embodiment of the invention will now be described by way of example, reference being made to the accompanying drawings, in which.

Figure 1:
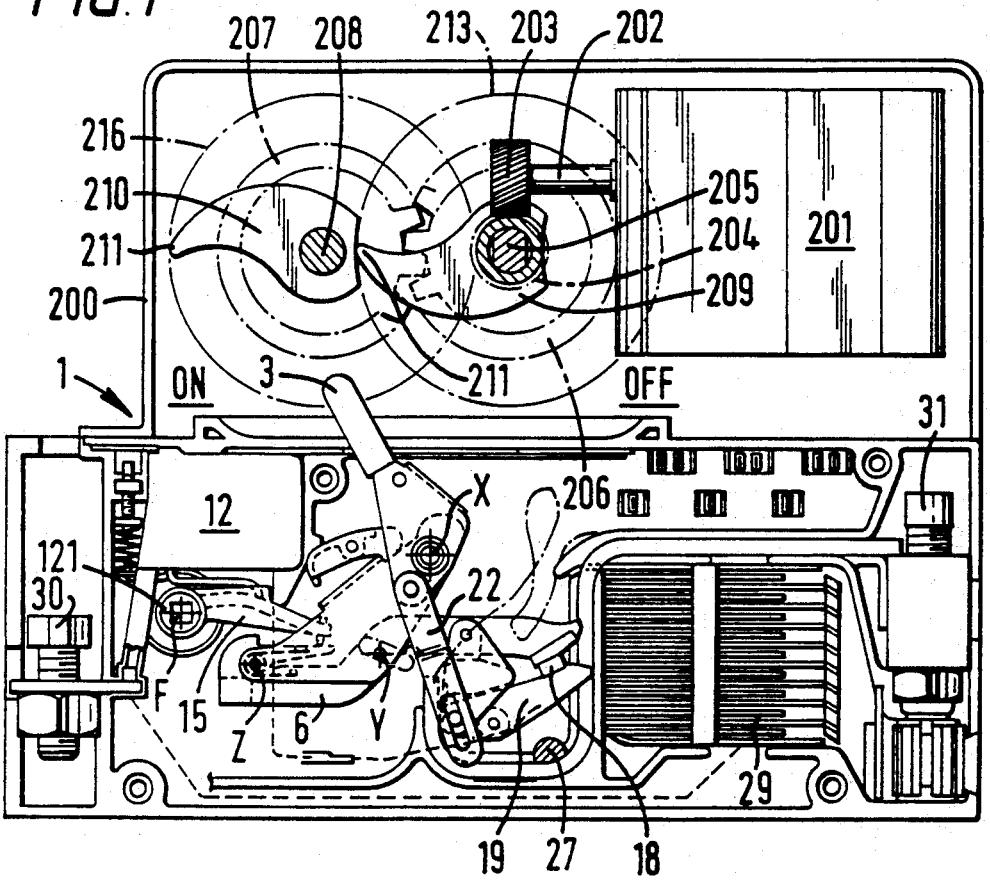
FIG. 1 shows the combination of a circuit breaker of the kind specified and an actuating device accroding to the invention.

The circuit breaker shown in FIG. 1 is similar to that described in our co-pending applications Nos. GB-90 02678.2 and U.S. Ser. No.-650,801. Like reference numerals are used in FIG. 1 to denote like parts with respect to that earlier application. The circuit breaker shown in FIG. 1 also incorporates the features disclosed in our co-pending applications Nos. GB-90 11804.3 and U.S. Ser. No.-650,801 which enable it to be used as a module in a system application and which is capable of being readily electrically and mechanically connected to a similar module. The disclosure of application Ser. No. 650,801 is incorporated herein by reference and like reference numerals are used to denote like parts.

In that application Ser. No. 650,801 there is described an assembly of three interconnected circuit breakers 1 each connected in the separate phase of a three-phase system, a switch unit 123 and an electronics unit 124. The switch unit 123 is for connection to the neutral line of the supply and could well be a switch or circuit breaker such as shown in FIG. 1. Some modification to the contacts might be required as the neutral switch or circuit breaker should close before the phase switches and open last. The electronics unit 124 is intended to process or respond to the line voltages and current transformer signals in a predetermined manner which can vary from application to application and its circuitry would be correspondingly tailored.

The present invention has application to such an assembly but can be used also where there are fewer phase connected circuit breakers. In the following example there is only one circuit breaker 1 and this is sandwiched between and electrically connected to the neutral switch 123 and the electronics unit 124. When any one of the units is tripped by the solenoid 12 actuating the lever 15, the key 121 actuates the levers 15 of the other units so that these also are tripped from the ON to the OFF condition. Mounted on and secured to the three unit assembly is a housing 200 which houses a motor 201 having an output drive shaft 202 which through a worm gear 203 drives a gear 204 on shaft 205 carrying spur gear 206 which meshes with gear 207 on shaft 208 so that the gears 206 and 207 rotate about spaced parallel axes in opposite directions to contra-rotate the respective shafts 205 and 208 on which they are mounted and the actuating arms 209 and 210 which they drive. The gear ratio of the gears 206 and 207 is 1:1.

FIG. 1 shows the actuating arms 209 and 210 in the position prior to actuating the circuit breaker from the ON to the OFF condition. The sequence of operations will, however, be better understood from FIGS. 2 to 6. The actuating arms 209 and 210 are somewhat sickle shaped having a concave leading edge and at the operative end remote from the respective shafts 205 and 208 have a relatively narrow nose 211 for engagement with the dolly 3 on an associated element whilst at the opposite end they have a relatively broad root portion by which they are mounted on their respective shafts 205 and 208.

As seen in FIGS. 1 to 6, the actuating arm 209 is arranged to be angularly displaced or rotated in the clockwise direction and the actuating arm 210 in the anti-clockwise direction. As will be appreciated, the axes of the shafts 205 and 208 are parallel to the axis X about which the dolly 3 pivots between the ON and OFF positions of the switch.

Figure 2:
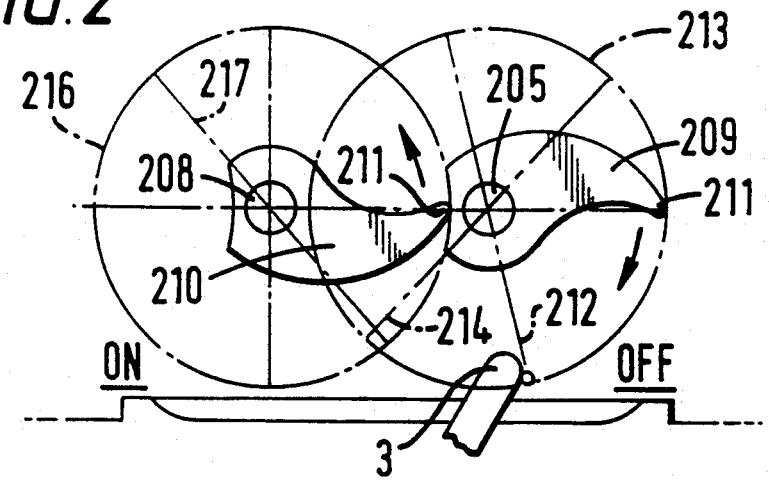
FIGS. 2 to 6 are diagrammatic views illustrating sequential positions of actuating elements of the actuating device in operation.
Figure 3:
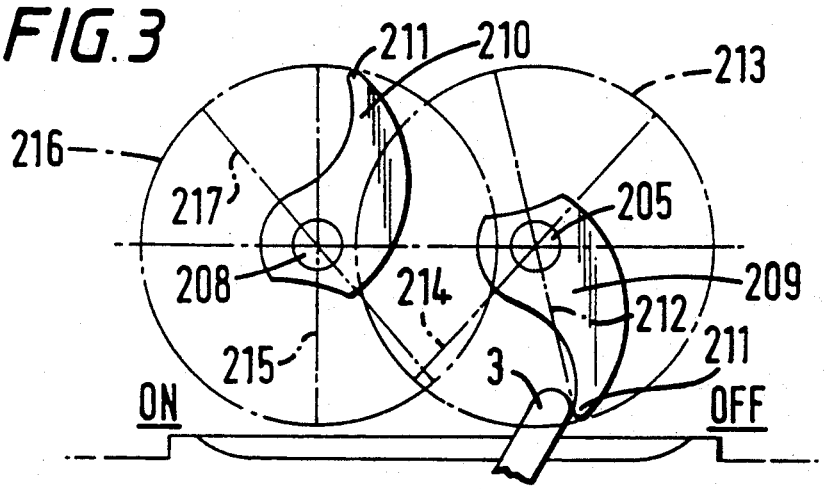
Figure 4:
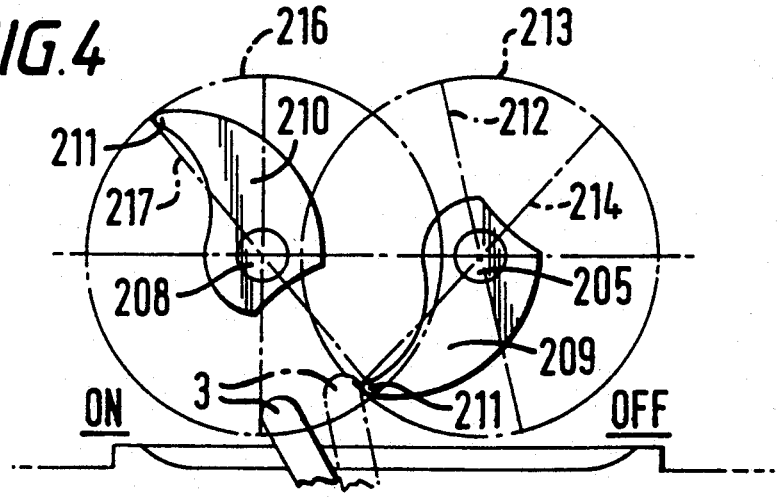

As seen in FIG. 2, the actuating arms 209 and 210 are in the rest position with their noses substantially on a horizontal axis normal to and passing through the axes of the shafts 205 and 208. When the motor 201 is actuated, it rotates the arms 209 and 210 through approximately 180° to the position shown in FIG. 5. During such rotation, the nose 211 of the arm 209 meets and engages the dolly 3 (FIG. 3) when the latter is in the OFF position (FIG. 2). It is preferred that such engagement of the dolly 3 occurs before the arm has completed 90° of rotation, e.g. 80°, as can be seen from the diameter 212 of the circular path 213 followed by the nose 211 of the arm 209. Continued rotation of the arm 209 displaces the dolly 3 about the axis X to just beyond the TDC position (as indicated by the diameter 214) (see FIG. 4) at which point the dolly 3 snaps over to the ON position. The angle between the diameters 212 and 214 is approximately 56° but this is not critical.

Figure 5:
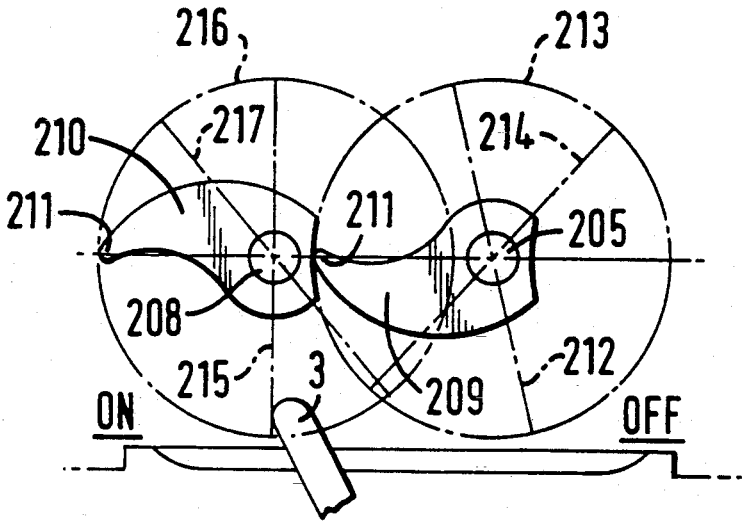
Figure 6:
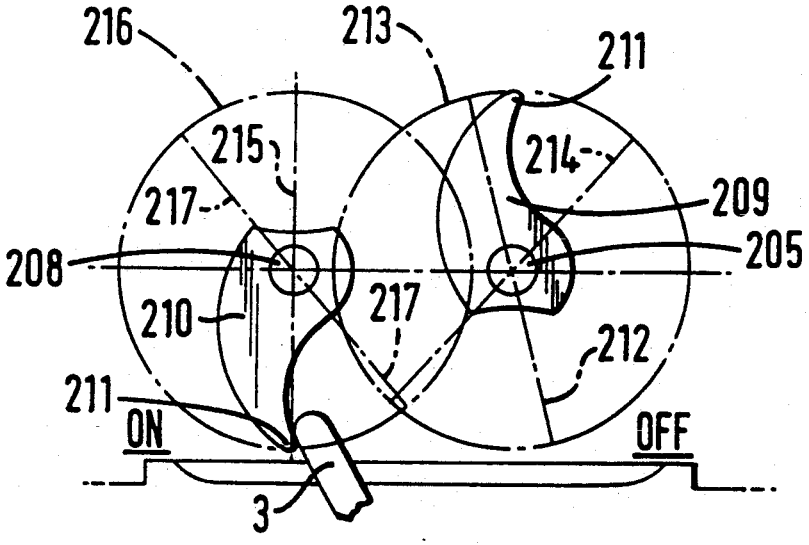

As will be appreciated, if the motor 201 had inadvertently rotated the arm 211 from the rest position shown in FIG. 2 through 180° in the wrong or anti-clockwise direction with the dolly 3 in the OFF position, the arms 210 and 211 would have finished in the position shown in FIG. 5 without engaging and actuating the dolly 3.

When it is desired to move the dolly 3 from the ON position to the OFF position, the motor 201 rotates the arm 209 through 180° in the clockwise direction and the arm 210 through 180° in the anti-clockwise direction. Starting from the position shown in FIG. 5 and finishing in the position shown in FIG. 2, it will be seen from FIG. 6 that the arm 210 engages the dolly 3 after a displacement of 90° with the nose 211 thereof on the diameter 215 of the circular path 216 which it follows. The dolly 3 is displaced to just beyond TDC position which is represented by the diameter 217 and then snaps over to the OFF position, the arms 209 and 210 finishing in the position shown in FIG. 2.

In this example, the angle between the diameters 215 and 217 is approximately 42° and it is notable that the angular displacement of the arm 210 to switch the dolly 3 from the ON to the OFF position is less than that required to switch the dolly from the OFF to the ON positions.

The motor 201 is a high speed motor capable of 9000 revolutions per minute and has a high reduction gear box in order to achieve the 180° rotation of the arms 209 and 210 rapidly and accurately. The arms 209 and 210 do not necessarily start in the ideal positions shown in FIGS. 2 and 5 as some under-run or over-run may occur but operation of the circuit breaker can be achieved in 0.3 to 0.6 seconds. The actuating arms 209 and 210 rotate in a common plane normal to the axes of the shafts 205 and 208 and to the axis X and, as they rotate in synchronism, they do not foul each other.

In this example there are three units, namely the phase circuit breaker 1, the switch unit or neutral phase breaker 123 and the electronic unit 124 all electrically and mechanically connected as described in our co-pending application Ser. No. 650,801. There are therefore three dollies 3 to be displaced and to achieve this, the three dollies are linked by an inverted U-section rigid strap 218 into which they extend. The actuating arms 209 and 210 in fact engage and displace this strap 218 which carries the three dollies 3 with it.

Figure 7:
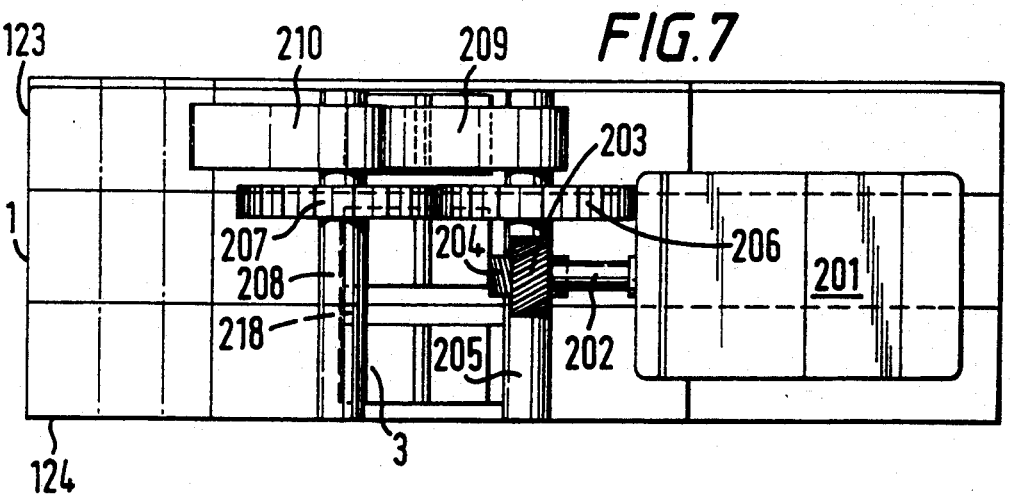
FIG. 7 is a top plan view of the combination shown in FIG. 1.
Figure 8:
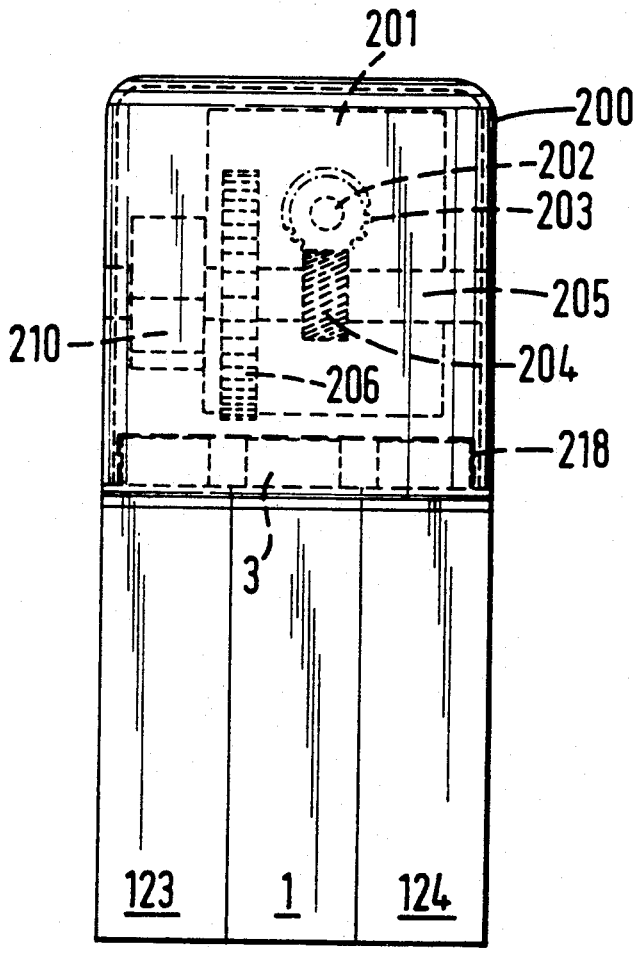
FIG. 8 is a front view of the combination shown in FIG. 1.

It will be noted from FIGS. 7 and 8 that the housing 200 is not symmetrically disposed with respect to the three units 1, 123 and 124 but is displaced towards the electronics unit 124. This has two advantages. Firstly, it facilitates electrical connection between the motor 201 and the electronic circuit within the unit 124 from which the actuating signal is derived so that no unsightly or accessible electrical connections appear. Secondly it provides space on the side remote from the actuating arms 209 and 210 so that the strap 218 is accessible and manual operation of the dollies 3 can be performed.

We claim:

1. The combination of a circuit breaker comprising a manually operable member which is angularly displaceable about an axis through a top dead centre (TDC) position between two extreme positions towards which it is urged by biasing means after passing through the TDC position to produce a toggle or snap action effect, the member in one extreme position causing or allowing a movable contact to engage another contact and in the other extreme position causing or allowing the moving contact to disengage the other contact, and an actuating device comprising an electric motor operable simultaneous to displace a pair of actuating arms in opposite directions, one actuating arm being displaced along a path in which it is operatively engageable with the member to displace the member about its axis in one direction and the other actuating arm being displaced along a path in which it is operatively engageable with the member to displace the member about its axis in the direction opposite to said one direction.

2. The combination according to claim 1 in which a plurality of circuit breakers of the kind specified are arranged in connected relationship with the associated element in the form of a strap connecting the members together and each actuating arm is arranged to engage the strap to actuate the members together.

3. The combination according to claim 1 in which the motor is arranged angularly to displace said pair of actuating arms in opposite directions about the respective axes of a pair of spaced parallel axes, the sweep of one arm passing through one extreme position of the member to displace the member towards the other extreme position and the sweep of the other arm passing through the other extreme position of the member to displace the member towards the one extreme position.

4. The combination according to claim 1 in which the motor drives the one arm through a first gear which drives a second gear to rotate the other arm in the opposite direction.

5. The combination of a circuit breaker comprising a manually operable member which is angularly displaceable about an axis through a top dead centre (TDC) position between two extreme positions towards which it is urged by biasing means after passing through the TDC position to produce a toggle or snap action effect, the member in one extreme position causing or allowing a movable contact to engage another contact and in the other extreme position causing or allowing the moving contact to disengage the other contact, and an actuating device comprising an electric motor operable simultaneously angularly to displace a pair of actuating arms in opposite directions about the respective axes of a pair of spaced parallel axes, the sweep of one arm passing through one extreme position of the member to displace the member towards the other extreme position and the sweep of the other arm passing through the other extreme position of the member to displace the member towards the one extreme position.

6. The combination according to claims 1 or 5, wherein the electric motor is unidirectionally operable to displace said actuating arms.

7. The combination of a circuit breaker comprising a manually operable member which is angularly displaceable about an axis through a top dead centre (TDC) position between two extreme positions towards which it is urged by biasing means after passing through the TDC position to produce a toggle or snap action effect, the member in one extreme position causing or allowing a movable contact to engage another contact and in the other extreme position causing or allowing the moving contact to disengage the other contact, and an actuating device comprising an electric motor operable to displace a pair of actuating arms in opposite directions, one actuating arm being displaced along a path in which it is operatively engageable with the member to displace the member about its axis in one direction and the other actuating arm being displaced along a path in which it is operatively engageable with the member to displace the member about its axis in the direction opposite to said one direction, the motor being arranged angularly to displace said pair of actuating arms in opposite directions about the respective axes of a pair of spaced parallel axes, the sweep of one arm passing through one extreme position of the member to displace the member towards the other extreme position and the sweep of the other arm passing through the other extreme position of the member to displace the member towards the one extreme position.

8. The combination of a circuit breaker comprising a manually operable member which is angularly displaceable about an axis through a top dead centre (TDC) position between two extreme positions towards which it is urged by biasing means after passing through the TDC position to produce a toggle or snap action effect, the member in one extreme position causing or allowing a movable contact to engage another contact and in the other extreme position causing or allowing the moving contact to disengage the other contact, and an actuating device comprising an electric motor operable to displace a pair of actuating arms in opposite directions, one actuating arm being displaced along a path in which it is operatively engageable with the member to displace the member about its axis in one direction and the other actuating arm being displaced along a path in which it is operatively engageable with the member to displace the member about its axis in the direction opposite to said one direction, the motor driving the one arm through a first gear which drives a second gear to rotate the other arm in the opposite direction.

* * * * *